US010673166B2

(12) United States Patent
Hung et al.

(10) Patent No.: US 10,673,166 B2
(45) Date of Patent: Jun. 2, 2020

(54) ELECTRICAL CONNECTOR HAVING A RETAINER

(71) Applicants: ALLTOP ELECTRONICS (SUZHOU) LTD., Suzhou, Jiangsu Province (CN); ALLTOP TECHNOLOGY CO., LTD., New Taipei (TW)

(72) Inventors: Yungchih Hung, New Taipei (TW); Wangi Yu, New Taipei (TW)

(73) Assignees: ALLTOP ELECTRONICS (SUZHOU) LTD., Suzhou, Jiangsu Province (CN); ALLTOP TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 16/245,167

(22) Filed: Jan. 10, 2019

(65) Prior Publication Data

US 2019/0214763 A1 Jul. 11, 2019

(30) Foreign Application Priority Data

Jan. 11, 2018 (CN) ..... 2018 1 0027857

(51) Int. Cl.

| | |
|---|---|
| ***H01R 13/514*** | (2006.01) |
| ***H01R 13/422*** | (2006.01) |
| ***H01R 4/18*** | (2006.01) |
| ***H01R 13/642*** | (2006.01) |
| ***H01R 12/52*** | (2011.01) |

(Continued)

(52) U.S. Cl.

CPC ..... *H01R 13/422* (2013.01); *H01R 4/185* (2013.01); *H01R 12/52* (2013.01); *H01R 13/4361* (2013.01); *H01R 13/6271* (2013.01); *H01R 13/642* (2013.01)

(58) Field of Classification Search

CPC ..... H01R 13/4361
USPC ..... 439/752, 746, 748
See application file for complete search history.

(56) References Cited

U.S. PATENT DOCUMENTS 5,653,613 A * 8/1997 Shimoda ..... H01R 13/4361 439/752
5,984,737 A * 11/1999 Nagano ..... H01R 13/4367 439/465

(Continued)

*Primary Examiner* — Neil Abrams
(74) *Attorney, Agent, or Firm* — Cheng-Ju Chiang

(57) ABSTRACT

An electrical connector includes an insulative housing and a plurality of contacts. Each contact has a retaining section, a mating section and a crimping section, the insulative housing defines a positioning groove communicated with contact-receiving passageways, the retaining section is provided with an elastic retaining arm extending backwards, a pair of cutouts on both sides of the retaining arm along a transverse direction, and a pair of limiting walls exposed in the cutouts and the positioning groove. When the contacts assembled to the relative contact-receiving passageways, each retaining arm is abutting against a rear inner surface of the positioning groove via a free end thereof to prevent the contact moving backwards, the electrical connector further comprises a retainer, and the retainer defines a plurality of limiting blocks extruding into the positioning groove and the corresponding cutouts, and the limiting blocks are abutting against the relative limiting walls.

19 Claims, 7 Drawing Sheets

(51) Int. Cl.
*H01R 13/627* (2006.01)
*H01R 13/436* (2006.01)

(56) References Cited

U.S. PATENT DOCUMENTS

| | | | | |
|---|---|---|---|---|
| 6,935,904 | B2 * | 8/2005 | Ishiyama | H01R 13/432 439/744 |
| 6,994,598 | B2 * | 2/2006 | Holmes | H01R 13/4361 439/752 |
| 7,445,524 | B2 * | 11/2008 | Horiuchi | H01R 13/4361 439/752 |
| 9,917,381 | B1 * | 3/2018 | Campbell | H01R 9/16 |
| 2019/0214763 | A1 * | 7/2019 | Hung | H01R 13/4361 |

* cited by examiner

ELECTRICAL CONNECTOR HAVING A RETAINER

CROSS REFERENCE TO RELATED APPLICATIONS

The present application claims the priority of Chinese Patent Application No. 201810027857.0, filed on Jan. 11, 2018, the content of which is incorporated herein by reference.

BACKGROUND OF THE INVENTION

1. Field of the Invention

The present invention relates to an electrical connector, and more particularly to an electrical connector having a better structural efficiency and retention.

2. Description of Related Art

A traditional electrical connector used for power transmission mainly comprises a plurality of contacts for power transmission and an insulative housing holding the contacts. Each contact is retained in the insulative housing via an elastic sheet thereof, the insulative housing defines a plurality of latching slots matching with the corresponding elastic sheets, thus the insulative housing may have a weak structure, and the electrical connector may be mated with a complementary connector by mistake.

Hence, it is desired to provide an electrical connector to overcome the problems mentioned above.

BRIEF SUMMARY OF THE INVENTION

Accordingly, an object of the present invention is to provide an electrical connector having a better structural efficiency and retention.

The present invention is directed to an electrical connector comprising an insulative housing and a plurality of contacts retained in the insulative housing. The insulative housing has a plurality of contact-receiving passageways extending along a front-and-back direction. The contacts are inserted into the corresponding contact-receiving passageways along a rear-to-front direction, each contact has a retaining section, a mating section extending forwards from the retaining section and a crimping section extending rearwards from the retaining section. The insulative housing defines a positioning groove opening outwards along an up-and-down direction, and the positioning groove is communicated with the contact-receiving passageways, the retaining section is provided with an elastic retaining arm extending backwards, a pair of cutouts on both sides of the retaining arm along a transverse direction, and a pair of limiting walls exposed in the cutouts and the positioning groove. When the contacts assembled to the relative contact-receiving passageways, each retaining arm is abutting against a rear inner surface of the positioning groove via a free end thereof to prevent the contact moving backwards, the electrical connector further comprises a retainer matched with the insulative housing, and the retainer defines a plurality of limiting blocks extruding into the positioning groove and the corresponding cutouts, and the limiting blocks are abutting against the relative limiting walls.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
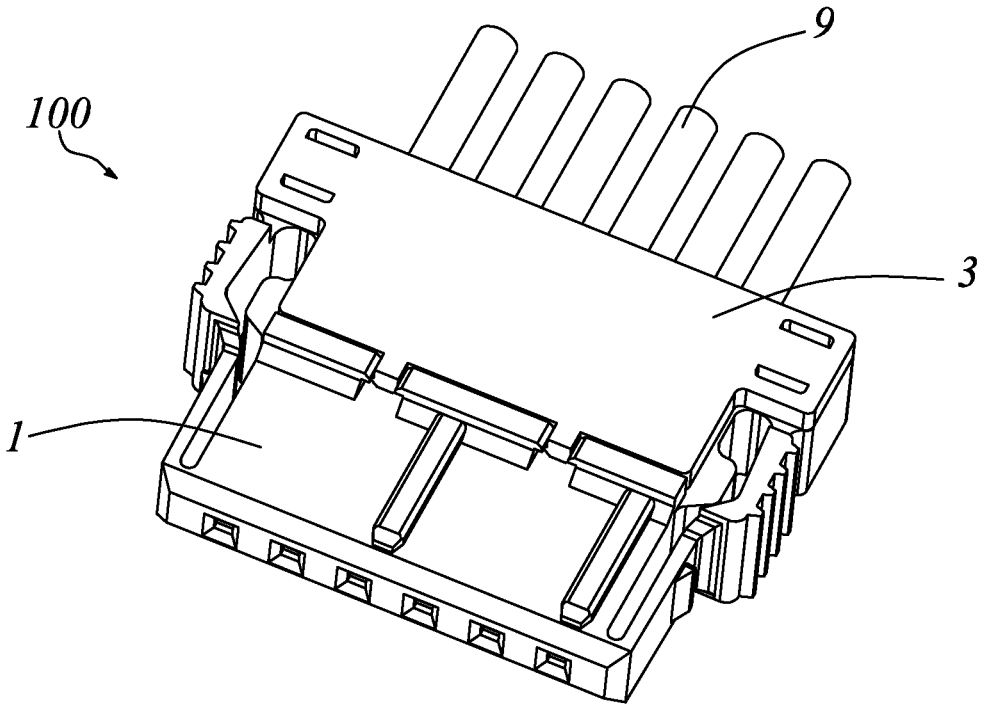
FIG. 1 is a perspective view of an electrical connector in accordance with a first embodiment of the present invention.
Figure 2:
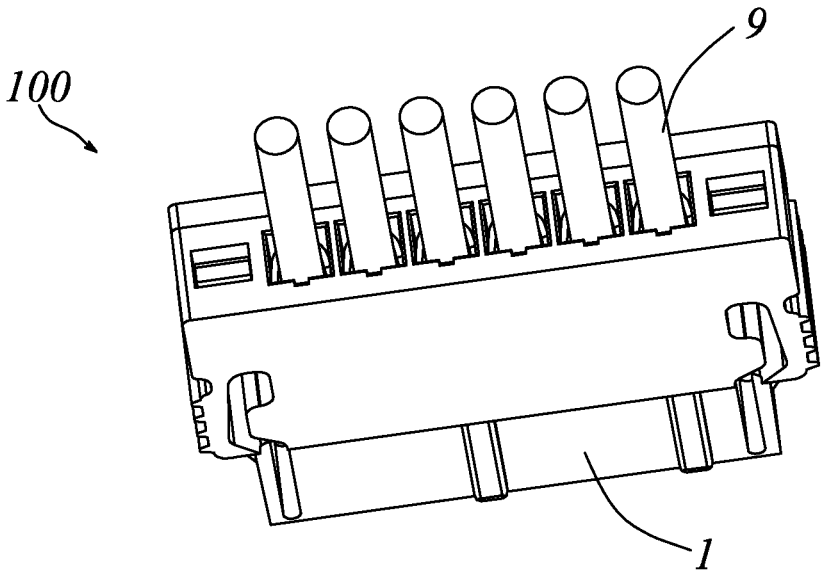
FIG. 2 is similar to FIG. 1, but viewed from a different angle.

Reference will be made to the drawing figures to describe the present invention in detail, wherein depicted elements are not necessarily shown to scale and wherein like of similar elements are designated by same or similar reference numeral through the several views and same or similar terminology.

FIGS. 1-7 illustrate an electrical connector 100 of the present invention, and the electrical connector comprises an insulative housing 1, a plurality of contacts 2 held in the insulative housing 1 and a number of wires 9 electrically connected with the contacts 2. In the present invention, the plugging direction of the electrical connector 100 is same as the length direction of each contact 2. In order to express convenience, hereinafter, the plugging direction of the electrical connector 100 or the length direction of each contact 2 also can be called as a front-and-back direction or a lengthwise direction, and a direction perpendicular to the lengthwise direction can be called as a transverse direction or an up-and-down direction.

The insulative housing 1 comprises a main portion 11, a mating portion 12 extending forwardly from the main portion 11, a pair of elastic latching arms 13 located on both sides of the main portion 11 and the mating portion 12, and a plurality of contact-receiving passageways 14 extending through the main portion 11 and the mating portion 12 along the front-and-back direction.

Figure 3:
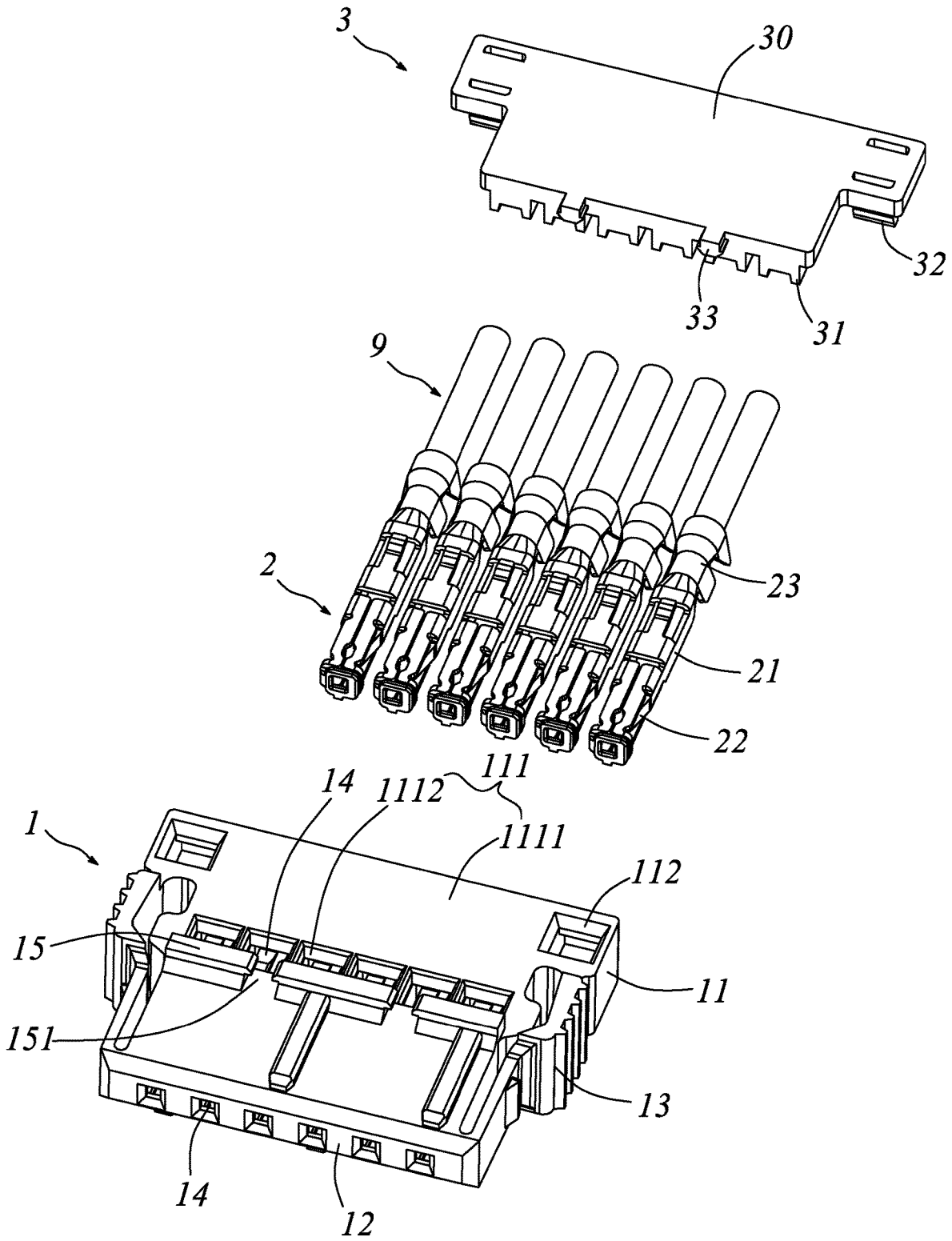
FIG. 3 is a partial exploded view of the electrical connector shown in FIG. 1.
Figure 4:
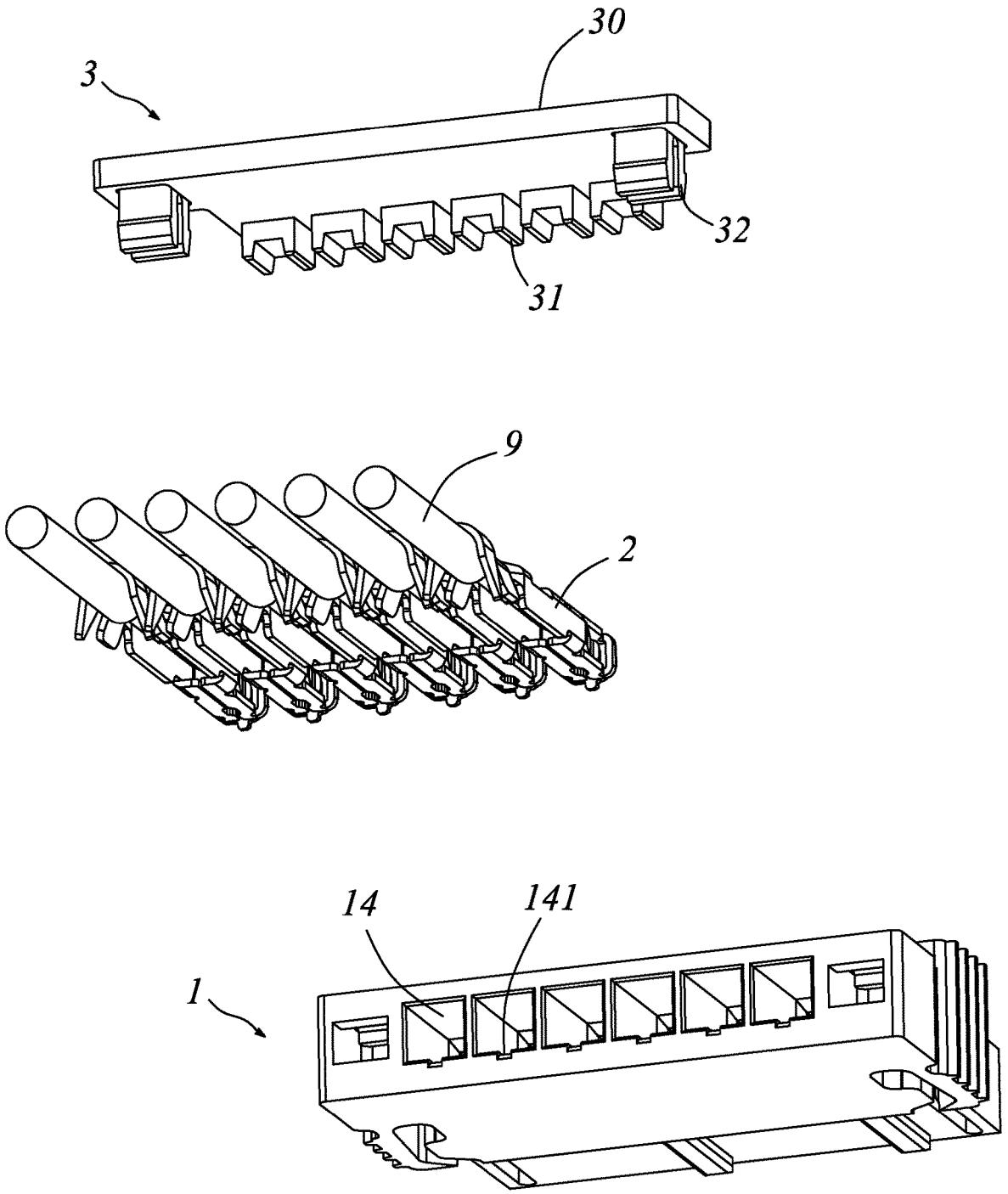
FIG. 4 is another exploded perspective view of the electrical connector shown in FIG. 3.
Figure 5:
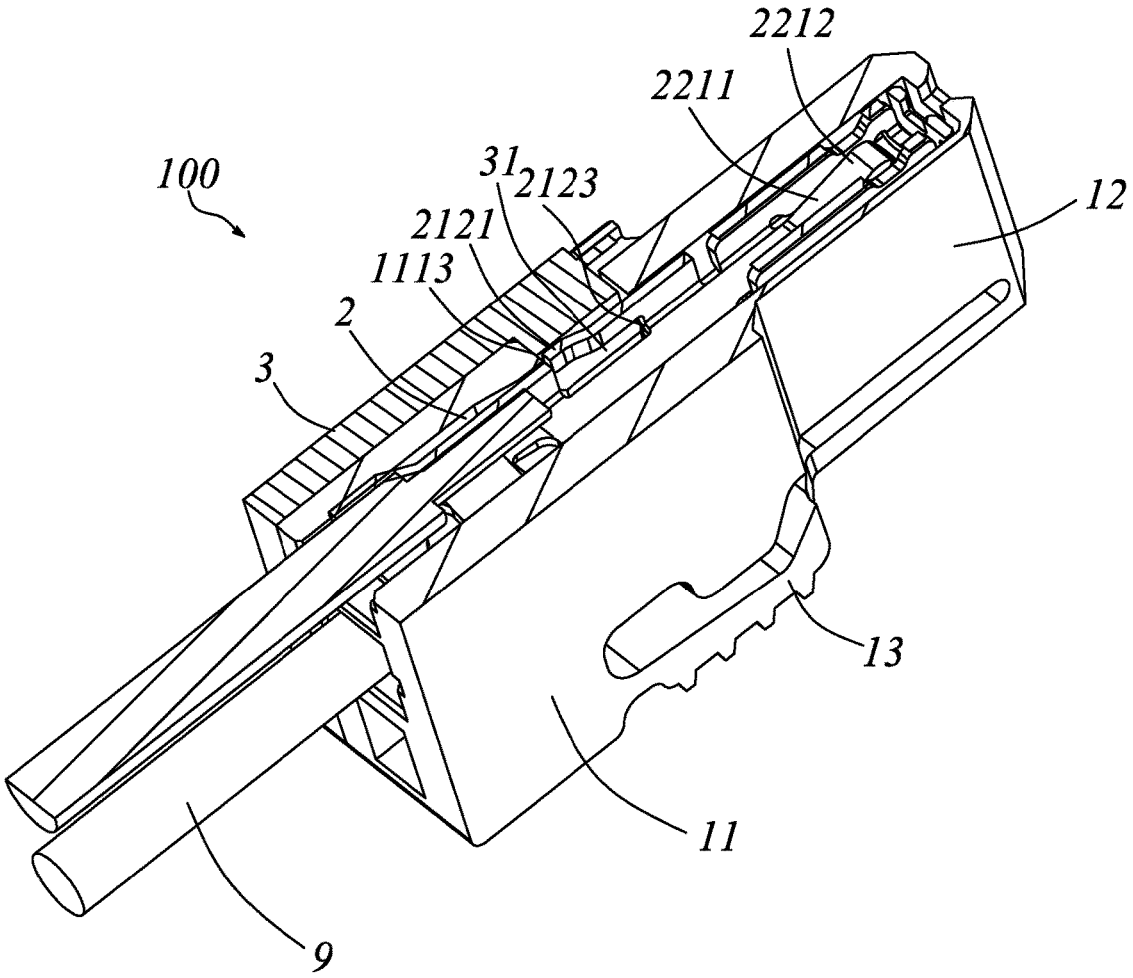
FIG. 5 is a cross-section view of FIG. 1, and showing a cooperative relationship between an insulative housing, a contact and a retainer.

The main portion 11 defines a positioning portion 111 opening outwards along the up-and-down direction, and the positioning portion 111 is communicated with the contact-receiving passageways 14. Specifically, as shown in FIGS. 3-5, the main portion 11 has a larger thickness and a larger width than the mating portion 12. The positioning portion 111 includes a first positioning area 1111 recessed downwards from a top surface of the main portion 11 and a plurality of second positioning grooves 1112 communicated with the first positioning area 1111 and the contact-receiving passageways 14.

There is a one-to-one correspondence between the second positioning grooves 1112 and the contact-receiving passageways 14. The main portion 11 further has a pair of fastening holes 112 neighboring to a back end thereof, and the fastening holes 112 is defined on two opposite sides of the main portion 11 along the transverse direction. The fastening holes 112 are communicated with the first positioning area 1111 along the up-and-down direction. At least two barriers 15 are disposed between the first positioning area 1111 and the mating portion 12, and two neighboring barriers 15 is separated from each other by an engaging slot 151. That is to say, the first positioning area 1111 is a sunken area compared with the barriers 15 and the latching arms 13.

The contacts 2 are assembled into the corresponding contact-receiving passageways 14 along a rear-to-front direction, and each contact 2 includes a retaining section 21, a mating section 22 extending forwards from the retaining section 21 and a crimping section 23 extending rearwards from the retaining section 21.

The retaining section 21 is provided with an elastic retaining arm 2121 extending backwards, a pair of cutouts 2122 on both sides of the retaining arm 2121 along the transverse direction, and a pair of limiting walls 2123 exposed in the cutouts 2122 and the positioning portion 111. When the contacts 2 assembled to the relative contact-receiving passageways 14, the retaining arm 2121 is abutting against a rear inner surface 1113 of the positioning portion 111 via a free end thereof, thus prevent the contacts 2 moving backwards. Specifically, the free end of the retaining arm 2121 is abutting against the rear inner surface of the relative second positioning groove 1112.

Additionally, referring to FIGS. 1-4, the electrical connector 100 further comprises a retainer 3 matched with the insulative housing 1, and the retainer 3 defines a plurality of limiting blocks 31 extruding into the positioning portion 111 and the corresponding cutouts 2122, and the limiting blocks 31 are abutting against the relative limiting walls 2123. Specifically, the retainer 3 further has a fixing plate 30 received in the first positioning groove area 1111, a pair of claspers 32 protruding downwards from the fixing plate 30 and at least one projection 33 protruding forwards from a front end of the fixing plate 30. The claspers 32 are located adjacent to a rear end of the fixing plate 30 and on both sides of the fixing plate 30, the claspers 32 are further locked with the relative fastening holes 112. The limiting blocks 31 are extending from a bottom surface of the fixing plate 30, when the retainer 3 assembled to the insulative housing 1, the limiting blocks 31 are inserted into the corresponding second positioning grooves 1112, and then inserted into the corresponding contact-receiving passageways 14. The projection 33 is assembled into the engaging slot 151.

Figure 6:
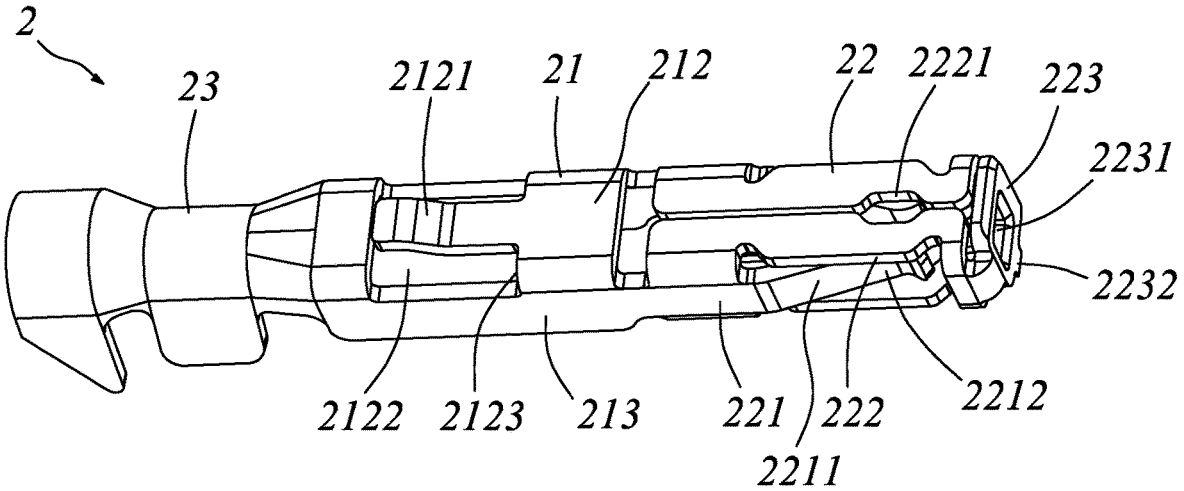
FIG. 6 is a perspective view of a contact of the electrical connector according to a first embodiment of the present invention.
Figure 7:
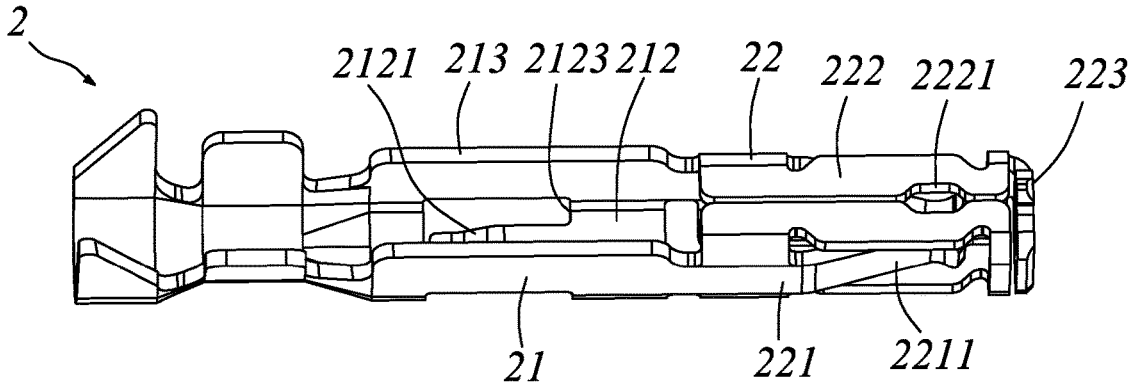
FIG. 7 is similar to FIG. 6, but viewed from a different angle.

In further, FIGS. 6-7 illustrate the contact 2 in the first embodiment, and conjunction with FIG. 5, the retaining section 21 of the contact 2 is of U-shaped, and comprises a middle wall 212 and a pair of lateral walls 213 extending from both sides of the middle wall 212 in a same direction. The retaining arm 2121 is located in the middle of the retaining section 21, and tore from the middle wall 212. The pair of cutouts 2122 are located on both sides of the retaining arm 2121 in the transverse direction, and the pair of limiting walls 2123 are also disposed on both sides of the retaining arm 2121.

Specially, the cutouts 2122 are formed in a conjoining area between the middle wall 212 and the lateral walls 213, thus the limiting walls 2123 is of L-shaped. Each contact 2 is defined corresponding to a pair of limiting blocks 31, each pair of limiting blocks 31 are assembled into the relative cutouts 2122 of the corresponding contact 2, and abutting against the relative limiting walls 2123.

The mating section 22 is of a rectangular tubular shape, and comprises a pair of opposite contacting walls 221, two protective wall groups bending from two opposite sides of the contacting walls 221, and a stopping portion 223 bending from a front end of one contacting wall 221 towards another contacting wall 221. Each protective wall group has two protective walls 222 extending towards each other. Each contacting wall 221 is connected with the corresponding lateral wall 213 on a same side to make the mating section 22 connected the retaining section 21, the contacting wall 221 and the lateral wall 213 on a same side are coplanar. In other embodiment, each protective wall group also can have only one protective wall 222 extending from one contacting wall 221 towards another contacting wall 221.

A contacting portion 2212 is formed on a front end of each contacting wall 221, and two contacting portions 2212 on opposite sides are extruding towards each other along the transverse direction. An elastic arm 2211 is tore from each contacting wall 221 and extends forwards, and each contacting portion 2212 is extending forwards from the relative elastic arm 2211 to form a V-shaped configuration.

Both sides of the contacting portions 2212 in the up-and-down direction are shaded by the protective walls 222. As each elastic arm 2211 tore from the contacting wall 221, a pair of tearing slits are formed in the contacting wall 221 and extending to both ends of the contacting wall 221 in the up-and-down direction, thus the relative side edges of the protective walls 222 are exposed in the tearing slits. In further, the side edges of the protective walls 222 corresponding to the tearing slits are extruding beyond the relative inner wall of the contacting wall 221, thus most segment of the elastic arms 2211 can be shaded by the protective walls 222. The periphery of the free end of each elastic arm 2211 is not extending beyond the periphery of the protective walls 222.

Therefore, during the installation process of the contact 2, the protective walls 222 can protect the elastic arms 2211 in the up-and-down and the transverse direction perpendicular to the installation direction, thus the elastic arms 2211 can be prevented from deformation when an extra force exerting on from above, from below, from the right or from the left. Moreover, as the two protective walls 222 in a group extending towards each other, the two contacting walls 221 also can be prevent from deformation when moving towards each other.

Furthermore, each protective wall group defines a testing hole 2221 extending through thereof in the up-and-down direction. The testing holes 2221 are aligning with the contacting portion 2212 along the transverse direction, thus users can observe the coating condition of the contacting portion 2212 from the testing holes 2221, and it's expedient for electroplating onto the contacting portion 2212.

Conjunction with FIGS. 5-6, the stopping portion 223 is bending from a front end of one contacting wall 221 and extending to cover a front end of another contacting wall 221. An inserting opening 2231 is penetrating through the stopping portion 223 along the plugging direction of the electrical connector 100, and for a complementary contact (not shown) plugging into. In the plugging direction of the electrical connector 100, free ends of the elastic arms 2211 are shaded by the stopping portion 223. Therefore, the free ends of the elastic arms 2211 can be prevent from abutting against the complementary contact, and then the phenomenon of the contact 2 destroyed by abutting against can be avoided, finally a smooth insertion can be guaranteed.

Referring to FIGS. 4-6, in the present invention, the stopping portion 223 defines a fool-proof protrusion 2232 on one side thereof, and a fool-proof depression 141 is defined in one side of each contact-receiving passageway 14 for matching with the fool-proof protrusion 2232. In the present embodiment, the fool-proof protrusion 2232 is disposed on a lateral edge of the stopping portion 223 neighboring to one protective wall group.

Figure 8:
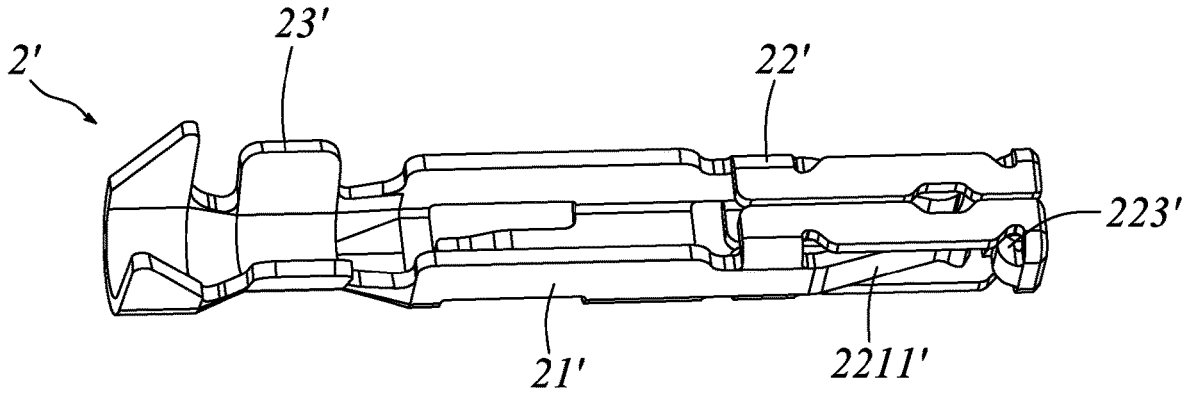
FIG. 8 is a perspective view of a contact of an electrical connector according to a second embodiment of the present invention.
Figure 9:
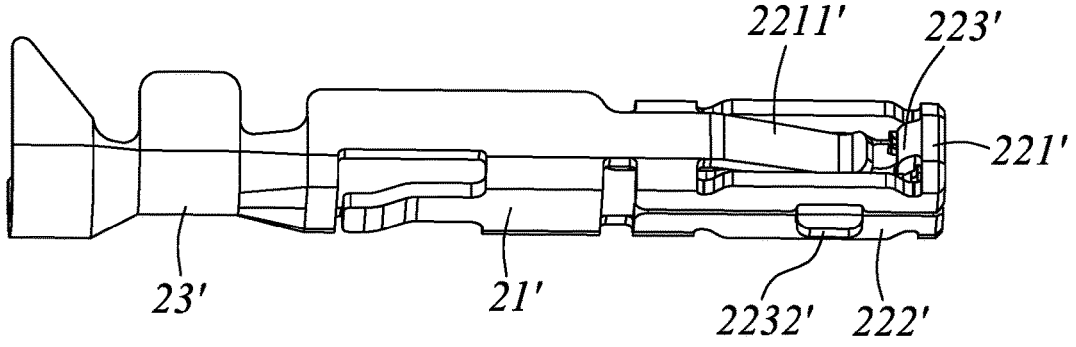
FIG. 9 is similar to FIG. 8, but viewed from a different angle.

FIGS. 8-9 illustrate a contact 2' according to a second embodiment of the present invention, and the contact 2' has a similar configuration as the contact 2 in the first embodiment of present invention. Each contact 2' also has a retaining section 21', a mating section 22' extending forwards from the retaining section 21' and a crimping section 23' extending rearwards from the retaining section 21'. Most constructs of the retaining section 21', the mating section 22' and the crimping section 23' are same as the contact 2 in the first embodiment, so the description for them is omitted here for the second embodiment. The difference is a stopping portion 223' in the front of the mating section 22', and detailed description for the difference is as follows.

In the second embodiment, the stopping portion 223' is served by a pair of extruding tabs, and each extruding tab is extending inwards from an inner edge of the contacting wall 221' neighboring to a free end of the elastic arm 2211'. In the plugging direction of the electrical connector, the free ends of the elastic arms 2211' are shaded by the stopping portion 223', therefore, the free ends of the elastic arms 2211' can be prevent from abutting against the complementary contact, and then the phenomenon of the contact 2' destroyed by abutting against can be avoided, finally a smooth insertion can be guaranteed.

In addition, the fool-proof protrusion 2232' is bending from an extending end of one protective wall 222' and extending along the up-and-down direction.

Figure 10:
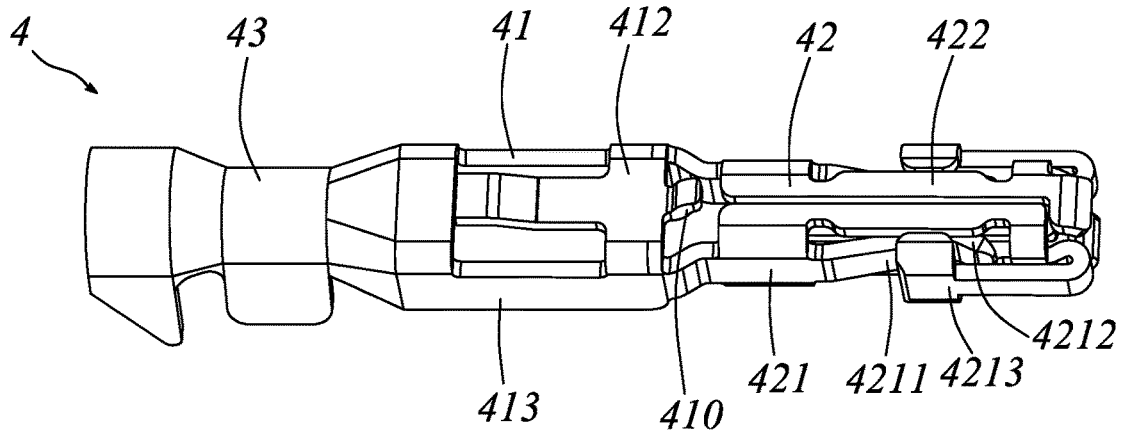
FIG. 10 is a perspective view of a contact of an electrical connector according to a third embodiment of the present invention.
Figure 11:
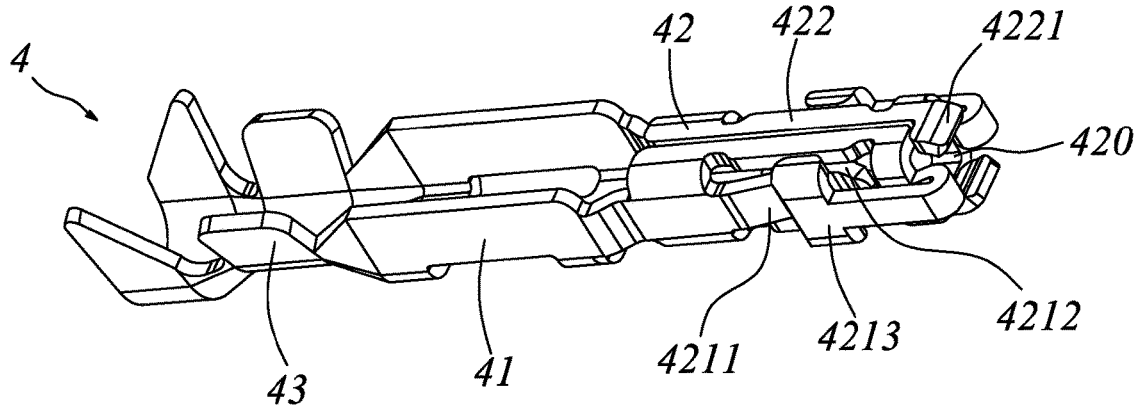
FIG. 11 is similar to FIG. 10, but viewed from a different angle.

FIGS. 10-11 illustrate a contact 4 according to a third embodiment of the present invention, and the contact 4 also has a retaining section 41, a mating section 42 extending forwards from the retaining section 41 and a crimping section 43 extending rearwards from the retaining section 41. Most constructs of the retaining section 41 and the crimping section 43 are same as the contact 2 in the first embodiment, so the description for them is omitted here for the third embodiment. The difference is the mating section 42 and a fool-proof protrusion 410, and detailed description for the difference is as follows.

In the present embodiment, the mating section 42 is of a rectangular tubular shape, and has a smaller outer diameter than the retaining section 41, therefore the mating section 42 is contracted compared with the retaining section 41.

The mating section 42 also comprises a pair of opposite contacting walls 421, two protective wall groups bending from two opposite sides of the contacting walls 421, and each protective wall group 422 has two protective walls 422 extending towards each other. Each contacting wall 421 is connected with the corresponding lateral wall 413 on a same side to make the mating section 42 connected the retaining section 41. A fool-proof protrusion 410 is extending outwards from a front end of a middle wall 412 of the retaining section 41.

Each contacting wall 421 has a contacting portion 4212, and two contacting portions 4212 on opposite sides are extruding towards each other along the transverse direction. An elastic arm 4211 is tore from each contacting wall 421 and extends forwards, and each contacting portion 4212 is extending forwards from the relative elastic arm 4211 to form a V-shaped configuration.

Both sides of the contacting portions 4212 in the up-and-down direction are shaded by the protective walls 422, thus the protective walls 422 can shield the contacting portions 4212 from both sides, and the contacting portions 4212 can be prevented from deformation when an extra force exerting on from both sides.

The mating section 42 further has a pair of protective shields 4213 bending backwards from a front end of the contacting wall 421, and each protective shield 4213 extends reversely to locate on the outside of the relative elastic arm 4211, thus protects the relative elastic arm 4211 from outside, and can provide a supporting force from outside, the elastic arms 4211 can be prevented from an excessive outward deformation. In further, each protective shield 4213 has a rear segment outside of the elastic arm 4211, and the rear segment has a larger dimension than the elastic arm 4211 along the up-and-down direction. Both lateral edges of each protective shield 4213 extend towards the protective walls 422, and are aligning with the protective walls 422, thus the protective shields 4213 can be prevented from moving inwards.

The mating section 42 defines an inserting opening 420 on a front end thereof for a complementary contact inserting into. Firstly, each protective shield 4213 extends forwardly and towards an interior of the inserting opening 420 slantly from the front end of the contacting wall 421, then extends reversely to locate on the outside of the relative elastic arm 4211. Therefore in the plugging direction of the electrical connector, the free end of each elastic arm 4211 is shaded by a conjoining area between the protective shield 4213 and the contacting wall 421, therefore, the free ends of the elastic arms 4211 can be prevent from abutting against the complementary contact, and then the phenomenon of the contact 4 destroyed by abutting against can be avoided, finally a smooth insertion can be guaranteed.

Additionally, one of the protective wall 422 defines a tab 4221 on a free end thereof, and the tab 4221 extends slantly towards the interior of the inserting opening 420, for guiding the complementary contact plugged into the pair of contacting portions 4212.

Figure 12:
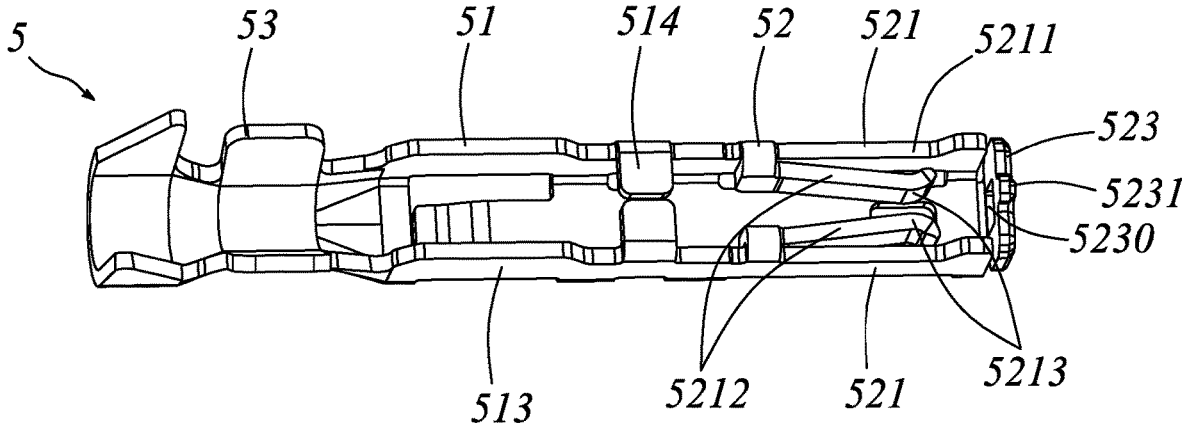
FIG. 12 is a perspective view of a contact of an electrical connector according to a fourth embodiment of the present invention.
Figure 13:
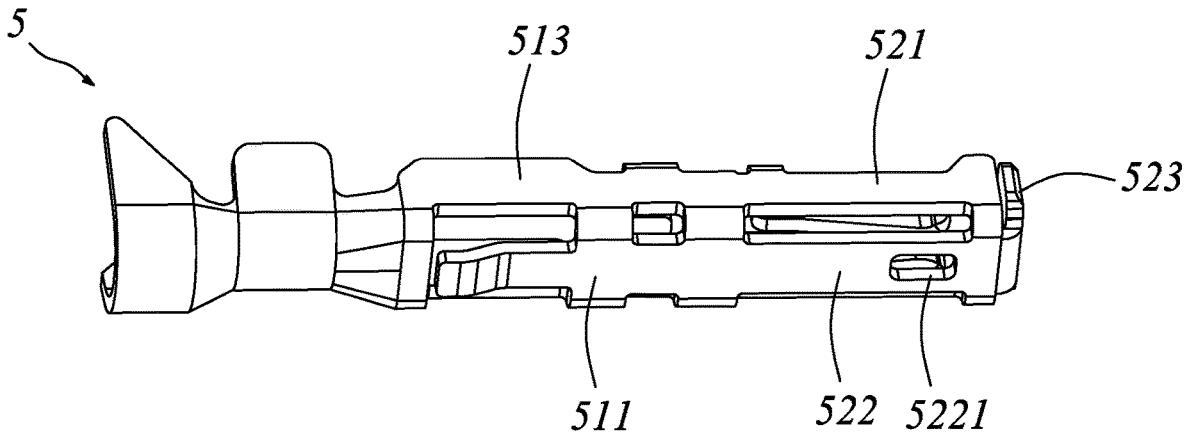
FIG. 13 is similar to FIG. 12, but viewed from a different angle.

FIGS. 12-13 illustrate a contact 5 according to a fourth embodiment of the present invention, and the contact 5 also has a retaining section 51, a mating section 52 extending forwards from the retaining section 51 and a crimping section 53 extending rearwards from the retaining section 51.

The retaining section 51 has a similar structure as the retaining section 21 in the first embodiment, and the difference is a pair of restricting pieces 514 formed on the retaining section 51, and the restricting pieces 514 are extending towards each other from side edges of relative lateral walls 513. The restricting pieces 514 can prevent the lateral walls 513 from moving towards each other. In other embodiment, only one restricting piece 514 is formed and extending from one lateral wall 513 towards another lateral wall 513, and the lateral walls 513 also can be prevented from moving towards each other.

The mating section 52 is also of U-shaped corresponding to the retaining section 51, and comprises a pair of opposite contacting walls 521 and a connecting wall 522 linked with the pair of opposite contacting walls 521. The contacting walls 521 are connected with the corresponding lateral walls 513 of the retaining section 51, and the connecting wall 522 is connected with a middle wall 511 of the retaining section 51.

Each contacting wall 521 comprises a primary plate 5211 directly connected with the retaining section 51, and an elastic arm 5212 bending from an opening end of the primary plate 5211 adjacent to the mating section 52. Each elastic arm 5212 includes a contacting portion 5213 protruding towards the opposite elastic arm 5212 for electrically connecting with a complementary contact. Each primary plate 5211 can protect the corresponding elastic arm 5212 from outside of the corresponding elastic arm 5212.

In addition, the mating section 52 further has a stopping portion 523 bending from a front end of the connecting wall 522, and the stopping portion 523 is disposed in front of free ends of the contacting walls 521. An inserting opening 5230 is defined through the stopping portion 523. In the plugging direction of the electrical connector, free ends of the elastic arms 5212 are covered by the stopping portion 523. A fool-proof protrusion 5231 is extending outwards from an extension end of the stopping portion 523.

Furthermore, a testing hole 5221 is defined through the connecting wall 522, and the testing hole 5221 is aligning with the contacting portions 5213 along the transverse direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative housing having a plurality of contact-receiving passageways extending along a front-and-back direction; and a plurality of contacts retained in the insulative housing, and the contacts being inserted into the corresponding contact-receiving passageways along a rear-to-front direction, each contact having a retaining section, a mating section extending forwards from the retaining section and a crimping section extending rearwards from the retaining section; wherein the insulative housing defines a positioning portion opening outwards along an up-and-down direction, and the positioning portion is communicated with the contact-receiving passageways, the retaining section is provided with an elastic retaining arm extending backwards, a pair of cutouts on both sides of the retaining arm along a transverse direction, and a pair of limiting walls exposed in the cutouts and the positioning portion;

when the contacts assembled to the relative contact-receiving passageways, each retaining arm is abutting against a rear inner surface of the positioning portion via a free end thereof to prevent the contact moving backwards, the electrical connector further comprises a retainer matched with the insulative housing, and the retainer defines a plurality of limiting blocks extruding into the positioning portion and the corresponding cutouts, and the limiting blocks are abutting against the relative limiting walls.

2. The electrical connector as claimed in claim 1, wherein the retaining section is of U-shaped, and the retaining arm is located in the middle of the retaining section, the pair of cutouts are located on both sides of the retaining arm in the transverse direction, and the pair of limiting walls are also disposed on both sides of the retaining arm, each contact is defined corresponding to a pair of limiting blocks.

3. The electrical connector as claimed in claim 1, wherein the mating section is of a rectangular tubular shape, and comprises a pair of opposite contacting walls and two protective wall groups bending from two opposite sides of the contacting walls, a contacting portion is formed on a front end of each contacting wall, and two contacting portions on opposite sides are extruding towards each other along the transverse direction, both sides of the contacting portions in the up-and-down direction are shaded by the protective wall groups.

4. The electrical connector as claimed in claim 3, wherein each protective wall group has two protective walls extending towards each other, or each protective wall group has only one protective wall extending from one contacting wall towards another contacting wall.

5. The electrical connector as claimed in claim 3, wherein an elastic arm is tore from each contacting wall and extends forwards, each contacting portion is formed on the relative elastic arm and of a V-shaped configuration protruding inwards, and the periphery of the free end of each elastic arm is not extending beyond the periphery of the protective walls.

6. The electrical connector as claimed in claim 4, wherein the mating section comprises a stopping portion, and the stopping portion is rising on a front end of the contacting wall or extending inwards from an inner edge of the contacting wall neighboring to a free end of the elastic arm, in the plugging direction of the electrical connector, free ends of the elastic arms are shaded by the stopping portion.

7. The electrical connector as claimed in claim 3, wherein an elastic arm is tore from each contacting wall and extends forwards, and each contacting portion is formed on the relative elastic arm, and the mating section further has a pair of protective shields bending backwards from a front end of the contacting wall, and each protective shield extends reversely to locate on the outside of the relative elastic arm.

8. The electrical connector as claimed in claim 7, wherein each protective shield has a rear segment outside of the elastic arm, and the rear segment has a larger dimension than the elastic arm along the up-and-down direction, both lateral edges of each protective shield extend towards the protective walls, and are aligning with the protective walls.

9. The electrical connector as claimed in claim 7, wherein the mating section defines an inserting opening on a front end thereof for a complementary contact inserting into, each protective shield extends forwardly and towards an interior of the inserting opening slantly from the front end of the contacting wall firstly, then extends reversely to locate on the outside of the relative elastic arm, in the plugging direction of the electrical connector, the free end of each elastic arm is shaded by a conjoining area between the protective shield and the contacting wall.

10. The electrical connector as claimed in claim 9, wherein the mating section further has a tab on a free end of one protective wall, and the tab extends slantly towards the interior of the inserting opening.

11. The electrical connector as claimed in claim 3, wherein the mating section comprises a stopping portion bending from a front end of one contacting wall towards another contacting wall, the stopping portion is shading a front end of another contacting wall, an inserting opening is penetrating through the stopping portion along the plugging direction of the electrical connector, at least one contacting portion is formed on a front end of an elastic arm tore from the relative contacting wall, in the plugging direction of the electrical connector, free ends of the elastic arms are shaded by the stopping portion.

12. The electrical connector as claimed in claim 11, wherein the stopping portion defines a fool-proof protrusion on one side thereof, and a fool-proof depression is defined in one side of each contact-receiving passageway for matching with the fool-proof protrusion.

13. The electrical connector as claimed in claim 3, wherein a fool-proof protrusion is protruding outwards from one protective wall, and a fool-proof depression is defined in one side of each contact-receiving passageway for matching with the fool-proof protrusion.

14. The electrical connector as claimed in claim 3, wherein at least one protective wall group defines a testing hole extending through thereof in the up-and-down direction, and the testing hole is aligning with the contacting portion along the transverse direction.

15. The electrical connector as claimed in claim 1, wherein the mating section is of U-shaped, and comprises a pair of opposite contacting walls and a connecting wall linked with the pair of opposite contacting walls, each contacting wall comprises a primary plate directly connected with the retaining section, and an elastic arm bending from an opening end of the primary plate adjacent to the mating section, each elastic arm has a contacting portion protruding towards the opposite elastic arm for electrically connecting with a complementary contact.

16. The electrical connector as claimed in claim 15, wherein the retaining section is of U-shaped, and comprises a pair of restricting pieces extending towards each other from side edges of relative lateral walls, or one restricting piece extending from one lateral wall towards another lateral wall.

17. The electrical connector as claimed in claim 15, wherein the mating section further has a stopping portion bending from a front end of the connecting wall, and the stopping portion is disposed in front of free ends of the contacting walls, an inserting opening is defined through the stopping portion, in the plugging direction of the electrical connector, free ends of the elastic arms are covered by the stopping portion.

18. The electrical connector as claimed in claim 17, wherein the stopping portion defines a fool-proof protrusion on one side thereof, and a fool-proof depression is defined in one side of each contact-receiving passageway for matching with the fool-proof protrusion.

19. The electrical connector as claimed in claim 15, wherein a testing hole is defined through the connecting wall, and the testing hole is aligning with the contacting portions along the transverse direction.

* * * * *